US005362258A

United States Patent [19]

Arnswald et al.

[11] Patent Number: 5,362,258

[45] Date of Patent: Nov. 8, 1994

[54] CABLE-ATTACHING DEVICE FOR A PUMP

[75] Inventors: Kurt-Werner Arnswald, Lohmar; Manfred Zelder, St. Augusti, both of Germany

[73] Assignee: Wilo GmbH, Dortmund, Germany

[21] Appl. No.: 114,317

[22] Filed: Aug. 30, 1993

[30] Foreign Application Priority Data

Sep. 9, 1992 [DE] Germany ..... 4230138

[51] Int. Cl.[5] ..... H01R 13/502

[52] U.S. Cl. ..... 439/695; 439/598; 439/271

[58] Field of Search ..... 439/692, 695, 697, 271–277, 439/589, 598

[56] References Cited

U.S. PATENT DOCUMENTS 2,655,638 10/1953 Allen ..... 439/271
3,519,975 7/1970 Prow, Jr. et al. ..... 439/271
4,193,655 3/1980 Herrman, Jr. ..... 439/271
4,497,531 9/1985 Baker ..... 439/271
4,588,247 5/1986 Grappe et al. ..... 439/271

*Primary Examiner*—Larry I. Schwartz
*Assistant Examiner*—Hien D. Vu
*Attorney, Agent, or Firm*—Herbert Dubno

[57] ABSTRACT

The invention relates to a device for attaching and connecting a multicore electric cable to the motor of a pump, more particularly a submersible motor-driven pump, having a tubular connecting casing, wherein the connecting casing is attached, more particularly screwed in an outwardly open aperture in the motor casing and/or in the pump bearing support and has internally a water-tight transverse wall which is disposed transversely of the longitudinal axis of the connecting casing and in which conductive pins are cast which project axis-parallel on both sides of the transverse wall and onto which on both sides bushes are fitted which are connected on the motor side to leads of the motor and on the outside to cores of a connecting cable.

8 Claims, 2 Drawing Sheets

CABLE-ATTACHING DEVICE FOR A PUMP

FIELD OF THE INVENTION

The present invention relates to device for attaching and connecting a multicore electric cable to the motor of a pump and, more particularly, to a submersible motor-driven pump having a tubular connecting casing.

BACKGROUND OF THE INVENTION

Various constructions are known for attaching an electric cable to a pump motor. In these prior art attachments, the cable ends are usually cast in place to prevent the penetration of longitudinally creeping water. Such connections sealed against longitudinally creeping water cannot be released and their assembly cost is relatively high.

OBJECT OF THE INVENTION

It is an object of the invention to provide an attachment device of the kind specified which is simply constructed and assembled and has high sealing properties against longitudinally creeping water, while at the same time allowing release for multiple connection.

SUMMARY OF THE INVENTION

This object is attained according to the invention by attaching the connecting casing, preferably by a screwthread connection, in an outwardly open aperture in the motor casing and/or in the pump bearing support and has internally a water-tight transverse wall which is disposed transversely of the longitudinal axis of the connecting casing and in which conductive pins are cast which project axis-parallel on both sides of the transverse wall and onto which on both sides bushes are fitted which are connected on the motor side to leads of the motor and on the outside to cores of a connecting cable.

Such a connecting device or such a cable connector enables the connecting cable to be releasably connected to the electric motor. Repeated connection is therefore possible, so that the customer or user can use and connect different kinds of cable. At the same time there is a high degree of hermeticity against longitudinally creeping water (i.e. the connection is nonwicking) and even protection against explosion, i.e. a spark from the motor cannot ignite gas on the outside the connection is flameproof.

While construction, assembly and demounting are simple, the offset cable ends are not altered when the cable is released, e.g. for repairs, so that reconnection can readily be performed. The device has identical members on both sides of the transverse wall, so that only a few members must be produced.

No changes to the motor casing are required, since there is no need for additional holes, bores or attachments, such as flanges. Particularly advantageously the connecting device according to the invention uses the same members for connections requiring or not requiring anti-explosion protection, so that two different constructions are not needed. The device has a multiple function, since the connecting casing can represent the receiving member for the connector, while at the same time inter-connecting the motor casing and the bearing support.

In general, when a cable has been detached from a motor, the dry inner chamber of submersible motors must be checked for sealing-tightness. When the cable is reconnected, hermeticity may break down, leading to leakage and the destruction of the motor. With the kind of construction according to the invention, the inside of the motor is not touched. It remains water-tight even if the motor were to be submerged under water without a cable. The hydraulic pressure testing of the motor for sealing-tightness is a separate, time-wasting operation. The motor is submerged in a filled basin of water and its interior is subjected via a pressurizing nipple to compressed air at approximately 1.5 bar. Then those places are examined which might show leakage, where air emerges in the form of bubbles which rise in the water. With the construction according to the invention such a testing operation is unnecessary if the cable has been subsequently released.

In prior art water-tight constructions the cable lead-in is often plugged with resin. In case of a further connection, therefore, either plugging with a synthetic resin must be repeated or a ready-to-use cable must be employed whose end already bears the plugging substance. In that case, therefore, it is a cable which the customer must obtain from the supplier. If motors and pumps protected against explosion are involved, the customer cannot in any case perform a cable change, but must obtain the explosion-protected components separately (they may be cast synthetic resin parts). In the construction according to the invention, the functions of longitudinal water hermeticity and anti-explosion protection are accommodated in the motor, separated from the cable.

A particularly simple and sealing-tight construction effective against longitudinally creeping water creepage and pressurized water is achieved if the transverse wall is enclosed by a coaxial sleeve into which the transverse wall is cast and which is attached water-tight to the inside wall of the connecting casing. Hermeticity is even further improved if a sealing disc through which the pins extend bears against one side of the transverse wall.

Constructional simplicity and ready assembly are achieved if the bushes on both sides of the transverse wall are each disposed in a two-part bearing member (plug-in member) which forms a guide channel for each bush sleeve. One half of the bearing member can be inserted in a central aperture in the other half via a central coaxial projection which forms latching tongues. Also advantageously the bearing member forms together with the inserted bush sleeves a plug-in member into which on one side the cable cores extend and which can be fitted via its other end onto the pins. Also according to the invention an identically constructed plug-in member can be fitted onto the pins on both sides of the transverse wall.

Optimum guiding is achieved if cast in the transverse wall is an axis-parallel or coaxial guide pin which projects on both sides and is in each case inserted in a bore in the bearing member. In addition, a readily assembled construction with reliable retention is obtained if on the outside a threaded sleeve is screwed in the connecting casing, she sleeve being inserted via its external thread in an internal thread of the connecting casing, the connecting cable including the cable jacket extending through the sleeve which is closed on the outside by a ring nut.

More particularly, the device for connecting the multi-lead electric cable to the pump motor can comprise:

a tubular connecting casing receivable in an aperture of the housing and secured thereto;

means forming a water-tight transverse wall in the casing;

a plurality of conductive pins cast in place in the wall and projecting axis-parallel on opposite sides of the wall;

respective bushes connected to leads of the cable and fitted over the conductive pins at an outer side of the wall in the casing; and respective bushes connected to leads of the motor and fitted over the conductive pins at an inner side of the wall in the casing.

The casing and housing can be interconnected by a screwthread whereby the casing is threaded into the housing. The transverse wall can be enclosed in a sleeve coaxially received in the casing and into which the wall is cast, the sleeve having the aforementioned water-tight connection to the inner wall of the casing.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
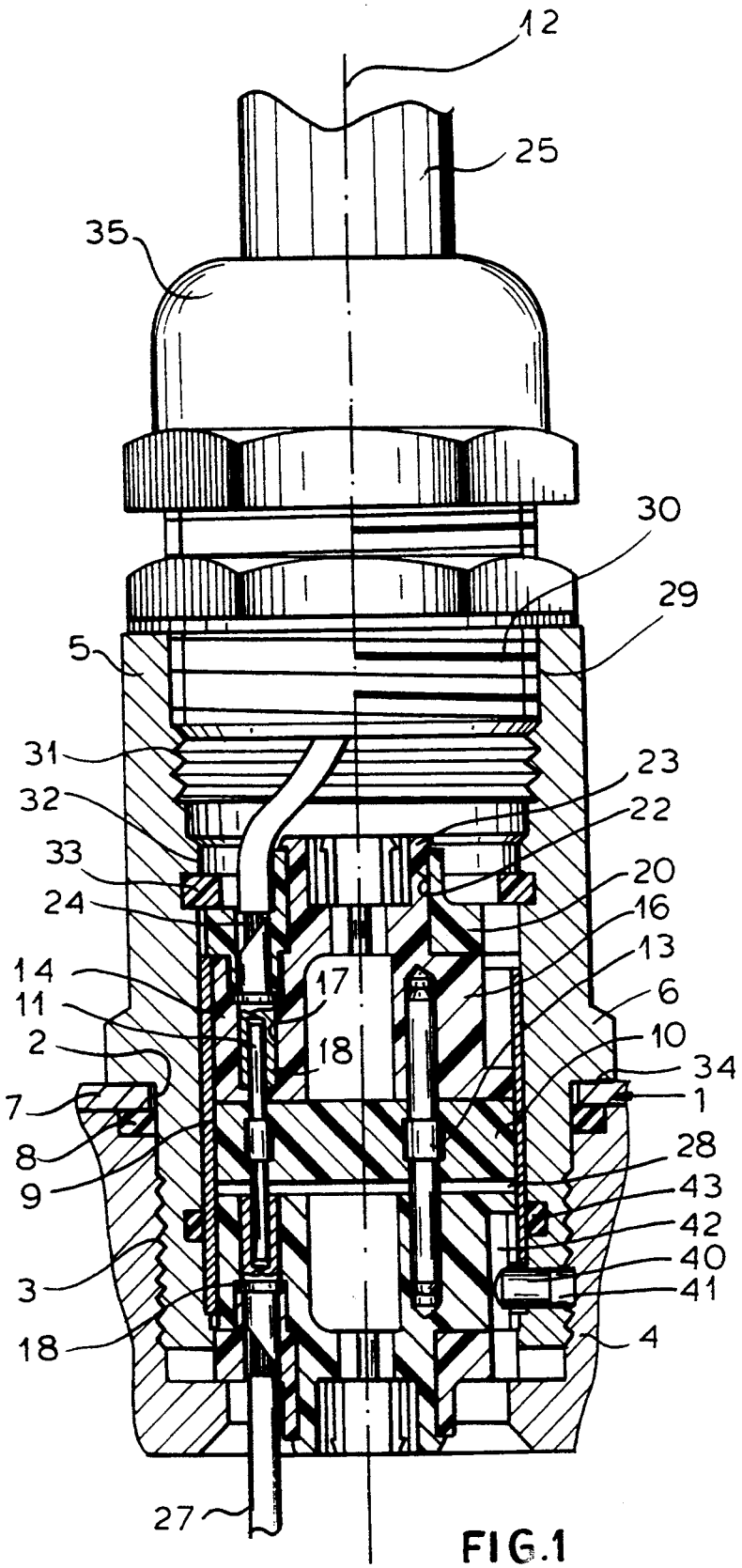
FIG. 1 is an axial sectional view through a connecting
Figure 2:
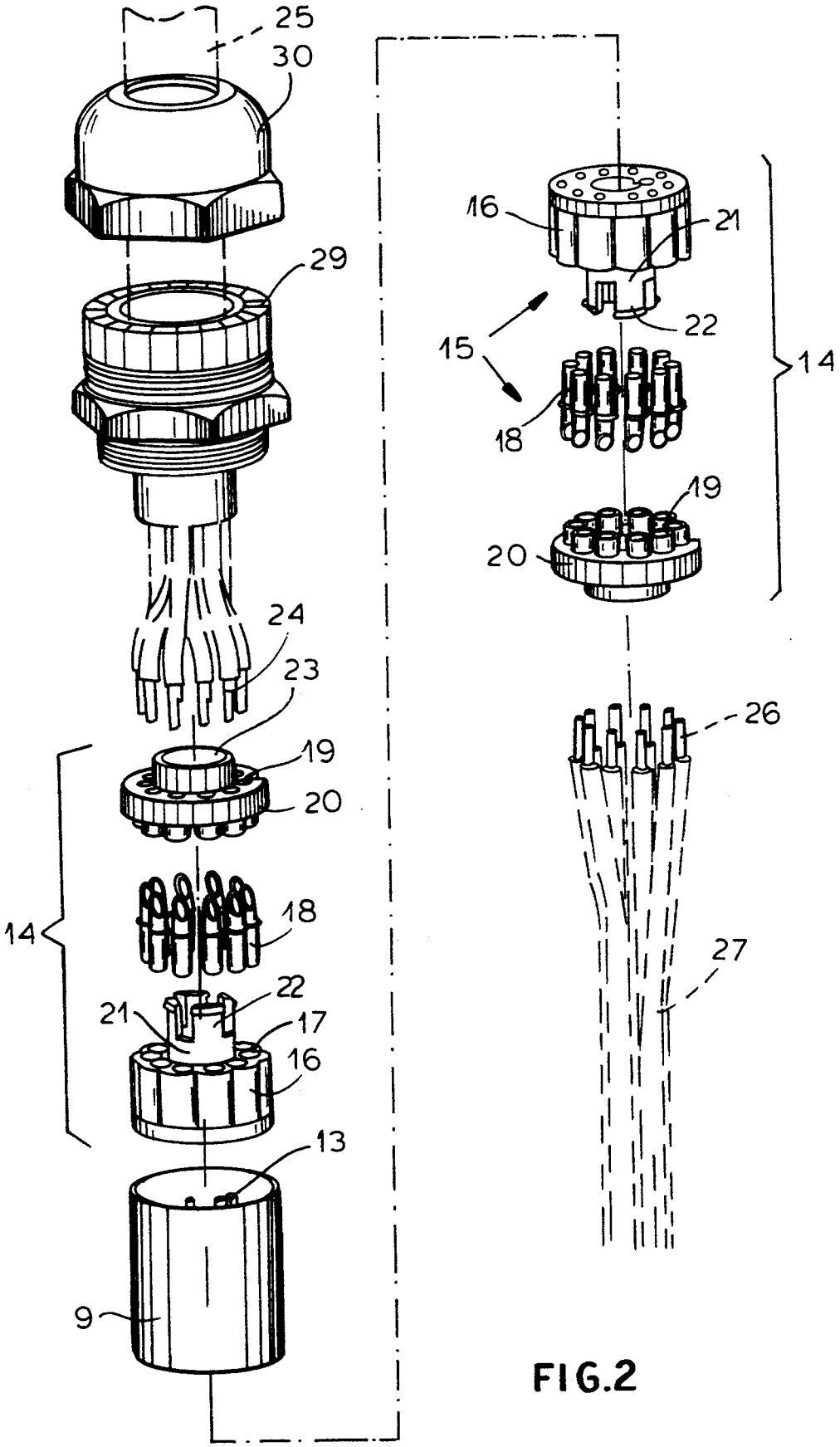
FIG. 2 is an exploded view thereof showing parts of the connecting device without the connecting casing.

A casing 1 of a pump motor, more particularly of a submersible motor-driven pump with a motor can, is formed with a bore 2 in a motor casing wall 7 which registers with a coaxial threaded bore 3. The tubular connecting casing 5 is therefore inserted as one part into the motor or bearing support 4 and has an outer ring or outer flange 6 engaging over motor casing wall 7, so that together with the screwing-in of the connecting casing 5 the motor casing wall 7 is screwed to the bearing support, a sealing ring 8 providing a seal between the connecting casing, the motor casing and the bearing support being inserted between the support 4 and the motor casing wall 7.

Coaxially inserted in the connecting casing 5 is a sleeve 9 which is attached, preferably by casing therein, to the inside wall of the connecting casing 5. Cast in the sleeve 9 is a transverse wall 10 of synthetic resin in which a number of conductive metal pins 11 are cast axis-parallel with the casing axis 12. At each end the pins project on both sides of the transverse wall 10.

Also cast in the transverse wall is a guide pin 13 which also projects on both sides of the transverse wall 10 and has a larger diameter than the pins 11.

The sleeve 9 is internally subdivided by the transverse wall 10 provided with the pins 11, 13 to form a two-sided double bush or socket into which two identically constructed plug-in members 14 from opposite sides. Each plug-in member 14 has two parts 15, namely, a first half 16 and a second half 20. The first half 16 is disposed closer to the transverse wall 10 and formed with a circle of guide bores 17 into which a number of bush sleeves 18 are inserted. On the side remote from the transverse wall 10 the sleeves project beyond the first half 16 into bores 19 in the second half 20. The first bearing member half 16 has a central coaxial projection 21 having a number of tongues 22 which are inserted into a central aperture 23 in the second bearing member half 20 and engage latchably therebehind.

The cores or wires 24 of the connecting cable 25 and the cores/wires 26 of the motor leads 27 respectively are attached to the bushes 18, so that the particular plug-in member 14 is attached to the connecting cable 25 or the motor leads 27 respectively on both sides of the transverse wall 10.

Bearing against one of the two sides of the transverse wall 10, in the embodiment illustrated against the side adjacent the motor, is a rubber disc 28 through which the pins 11 and 13 extends and which further improves sealing-tightness against longitudinal water. The rubber disc can also be disposed on both sides of the transverse wall 10.

Extending through the connecting cable 25 on the side of the connecting device adjacent the motor is a threaded sleeve 29 which is screwed by its external threading into an internal threading 30 of the connecting casing 5. The threaded sleeve 29 consists of an elastomer and at the end remote from the motor can be circularly compressed in radial directions by a ring nut 35 screwed on the outside. The outer jacket of the connecting cable 25 is clamped by the threaded sleeve 29 via the tightening of the ring nut 33.

As can be seen from FIG. 1, the threaded sleeve 29 has a male screwthread 30 which is threadedly received in a female screwthread 31 formed in the casing which can also have a shoulder 32 against which a split ring 33 is seated to immobilize the assembly of the plug-in members and the transverse wall 10. The casing has an external shoulder 34 seated against the housing structures. A pin 40 can extend through a bore 41 of the casing 5 to align the lower plug in member by engaging an axially-extending groove 42 thereof. Sealing with respect to the sleeve 9 is effected in part by a sealing ring 43.

We claim:

1. A flame-proof nonwicking device for connecting a multilead electric cable to a pump motor having a housing, said device comprising:

a tubular connecting casing receivable in an aperture of said housing and secured thereto;

means forming a water-tight transverse wall in said casing;

a plurality of conductive pins cast in place in said wall and projecting axis-parallel on opposite sides of said wall;

respective bushes connected to leads of said cable and fitted over said conductive pins at an outer side of said wall in said casing; and respective bushes connected to leads of said motor and fitted over said conductive pins at an inner side of said wall in said casing, said casing and said housing being interconnected by screwthreads whereby said casing in threaded into said housing, the bushes on each side of said transverse wall being received in a respective two-part bearing member forming a guide channel for the respective bush said bearing member lying in said casing to a respective side of said transverse wall.

2. The device defined in claim 1 wherein said transverse wall is enclosed in a sleeve coaxially received in said casing and into which said wall is cast, said sleeve having a water-tight connection to an inner wall of said casing.

3. The device defined in claim 2, further comprising a sealing disk through which said pins extend at a respective side of said wall and bearing against said side of the transverse wall.

4. The device defined in claim 1 wherein one part of each bearing member has a central projection coaxial with the casing and received in a central aperture of the other part of the bearing member, said central projections being formed by tongues holding the parts of the bearing members together.

5. The device defined in claim 4 wherein each bearing member and the bushes received therein forms a respective plug into which respective leads extend on one side and which can be fitted on an opposite side on said pins.

6. The device defined in claim 5 wherein said plug is constructed to fit onto the pins on either side of said transverse wall.

7. The device defined in claim 1 wherein a coaxial guide pin is cast in place in said transverse wall and projects on opposite sides thereof, said bearing members having bores receiving said guide pin.

8. The device defined in claim 1, further comprising a threaded sleeve having an external screwthread threaded into an internal screwthread in an end of said casing remote from said housing, said cable passing through said sleeve and being secured to said casing by a compression nut threaded onto said sleeve.

* * * * *